US007823220B2

(12) United States Patent
Mazzarolo

(10) Patent No.: US 7,823,220 B2
(45) Date of Patent: Nov. 2, 2010

(54) MULTI-CONFIGURATION ITEM OF CLOTHING

(75) Inventor: Giovanni Mazzarolo, Coste Di Maser (IT)

(73) Assignee: Alpinestars Research SRL, Costi Di Maser (IT)

( * ) Notice: Subject to any disclaimer, the term of this patent is extended or adjusted under 35 U.S.C. 154(b) by 0 days.

(21) Appl. No.: 11/995,430

(22) PCT Filed: Jul. 3, 2006

(86) PCT No.: PCT/EP2006/063784

§ 371 (c)(1),
(2), (4) Date: Jan. 11, 2008

(87) PCT Pub. No.: WO2007/006676

PCT Pub. Date: Jan. 18, 2007

(65) Prior Publication Data

US 2008/0216206 A1 Sep. 11, 2008

(30) Foreign Application Priority Data

Jul. 14, 2005 (IT) ..... TV20050034 U

(51) Int. Cl.
*A41D 3/02* (2006.01)
*A41D 1/02* (2006.01)

(52) U.S. Cl. ..... 2/96; 2/85; 2/93; 2/108

(58) Field of Classification Search ..... 2/102, 2/108, 94–96, 85, 92, 4, 45
See application file for complete search history.

(56) References Cited

U.S. PATENT DOCUMENTS

| | | | | |
|---|---|---|---|---|
| 1,271,047 | A * | 7/1918 | McQuarrie | 2/95 |
| 1,915,597 | A * | 6/1933 | Ducker | 2/95 |
| 2,051,482 | A * | 8/1936 | Bernard | 2/95 |
| 2,301,527 | A * | 11/1942 | English et. al. | 2/95 |
| 2,594,259 | A | 4/1952 | Fitch | |
| 2,711,539 | A | 6/1955 | Lily | |
| 4,470,155 | A | 9/1984 | Maeshima | |
| 4,864,656 | A | 9/1989 | Nesse | |
| 5,029,344 | A | 7/1991 | Shannon et al. | |
| 5,040,243 | A * | 8/1991 | Tatsuno | 2/108 |
| 5,718,000 | A | 2/1998 | Ost et al. | |
| 6,345,393 | B1 | 2/2002 | Bayer | |
| 6,728,970 | B1 | 5/2004 | Grilliot | |
| 6,868,558 | B2 * | 3/2005 | Majerfeld | 2/96 |

FOREIGN PATENT DOCUMENTS

FR 2557435 7/1985

OTHER PUBLICATIONS

Gershamn, MD, Maurice; The Journal of the American Medical Association; p. 930, vol. 68, No. 7;"Self-Adhesive Nylon Tapes".*
Written Opinion and International Search Report dated Dec. 5, 2006 from the corresponding PCT/EP2006/063784.

* cited by examiner

*Primary Examiner*—Gloria Hale
(74) *Attorney, Agent, or Firm*—Katten Muchin Rosenman LLP

(57) ABSTRACT

An item of clothing is convertible between different configurations. A vest may be removably fixed onto a jacket by devices different from those which are used to fix together the front portions of the jacket.

20 Claims, 2 Drawing Sheets

10
17
18
13

10
17
14
21,22
18
16
12
19,20
11
15

30
33

35,36
32
31
30

17
33
18

36
22
20
19
21
35

18
32
14
22,36
19,20
21
11
35
31
17

MULTI-CONFIGURATION ITEM OF CLOTHING

FIELD OF THE INVENTION

The present invention relates to an item of clothing convertible between different configurations. Although in the present invention reference is made to an item of clothing for motorcyclists, this must not be regarded as limiting in any way application of the invention and its mode of use.

BACKGROUND ART

Convertible items of clothing comprise various parts, some of which may be used only optionally and/or are interchangeable with other parts, this offering the user the advantage of being able to wear the same item of clothing in different conditions and/or during any season of the year.

The patent U.S. Pat. No. 2,594,259 describes a convertible item of clothing comprising two parts, namely a jacket and a vest, which may be fixed to each other and therefore worn at the same time, for example during the winter season. The same zip fastener which fixes together the front portions of the vest is also used to attach the vest to the inner side of the jacket. The vest, which may be lined, may also be worn separately, i.e. without the jacket, but it is obvious that, in order to change from a first ("heavy") configuration, where the jacket and vest are worn at the same time, to a second ("light") configuration, the jacket must first be taken off before the vest can be removed Convertibility of the item of clothing is therefore not straightforward. Moreover, it is not possible to wear the vest on top of the jacket.

The patents U.S. Pat. Nos. 4,470,155, 4,864,656 and 5,718,000 describe other examples of convertible items of clothing, all of which have a somewhat complex structure and in which conversion between the various configurations is even less easy.

Object and subject-matter of the invention

For users it would be desirable, and this forms an object of the present invention, to provide items of clothing comprising a jacket and a vest which have a particularly simple structure and which can be very easily converted from one configuration to another.

These and other objects are achieved with an item of clothing having the characteristic features claimed below.

BRIEF DESCRIPTION OF THE DRAWINGS

In order to clarify better these characteristic features and the consequent advantages, a preferred, but not exclusive embodiment of the invention will now be described with reference to the accompanying drawing in which.

DETAILED DESCRIPTION

The item of clothing according to the invention comprises a jacket 10 and a vest 30 and can be converted between various configurations, i.e.: a first configuration which consists in the jacket 10 alone, a second configuration which consists in the vest 30 alone, a third configuration which consists in the vest 30 fixed on top of the jacket 10 and a fourth configuration where the vest 30 is worn underneath the jacket 10.

Figures 1A, 1B, 2A, 2B:
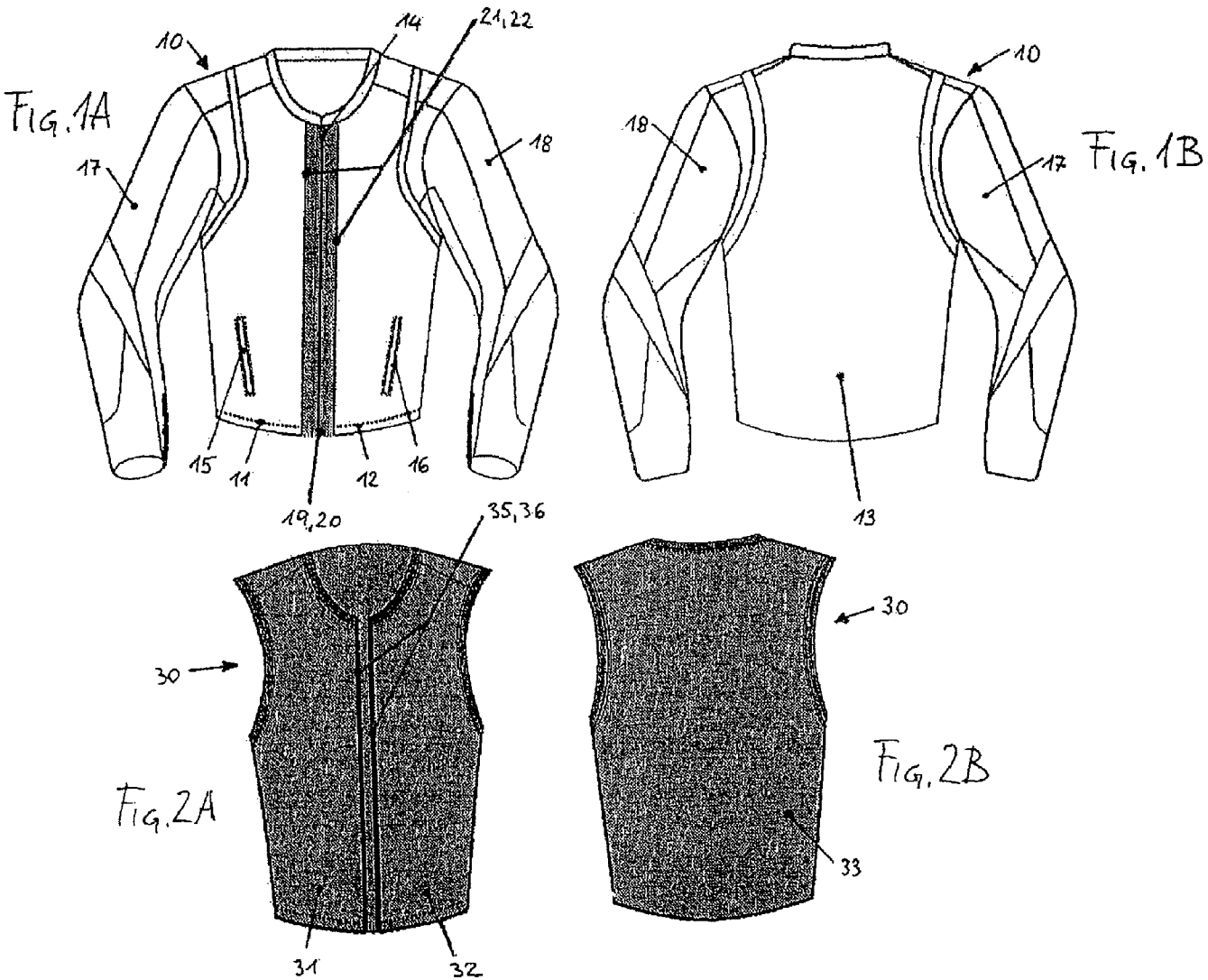
FIGS. 1A and 1B show, from the front and rear respectively, a jacket which forms a first part of a convertible item of clothing according to the invention intended for motorcyclists.
FIGS. 2A and 2B show, from the front and rear respectively, a vest which forms a second part of the said convertible item of clothing.

FIGS. 1A and 1B show a jacket for motorcyclists 10, which is preferably made using exclusively, or at least mainly, leather parts. The jacket 10 has two front portions 11 and 12 provided with pockets 15 and 16, two sleeves 17 and 18 and a rear portion 13. The portions 11 and 12 may be fixed to each other by means of a first fixing means which, in this embodiment of the invention, consists of a central vertical zip fastener formed (in addition to a sliding engaging piece 14, shown in FIGS. 1A and 3A) by two rows of teeth 19 and 20 which, from hereon, will be referred to as first row of teeth and second row of teeth. In a manner known per se, the rows of teeth 19 and 20 are provided along the vertical free edges of the respective front portions 11 and 12. Optionally, the jacket 10 may be provided with a padding fixed in a removable manner to its inner side and consequently not visible in the accompanying drawings.

As already mentioned hereinabove, when worn alone, namely without the vest 30, the jacket 10 forms the first configuration of the present convertible item of clothing.

FIGS. 2A and 2B show a sleeveless vest 30, which is usually made with materials which are lighter and/or less strong and less costly than those of the jacket 10 and which, when worn on its own, namely without the jacket 10, forms the second configuration of the present convertible item of clothing. The vest 30 comprises two front portions 31 and 32 and a rear portion 33. A third row 35 and a fourth row 36 of teeth are sewn, respectively, along the vertical free edges of the front portions 31 and 32 of the vest 30. When they cooperate with another sliding engaging piece (for the sake of simplicity not shown) the third row 35 and the fourth row 36 of teeth form a second fixing means of the present item of clothing, by means of which the front portion 31 of the vest 30 is fixed to the other front portion 32.

Figures 3A, 3B, 4:
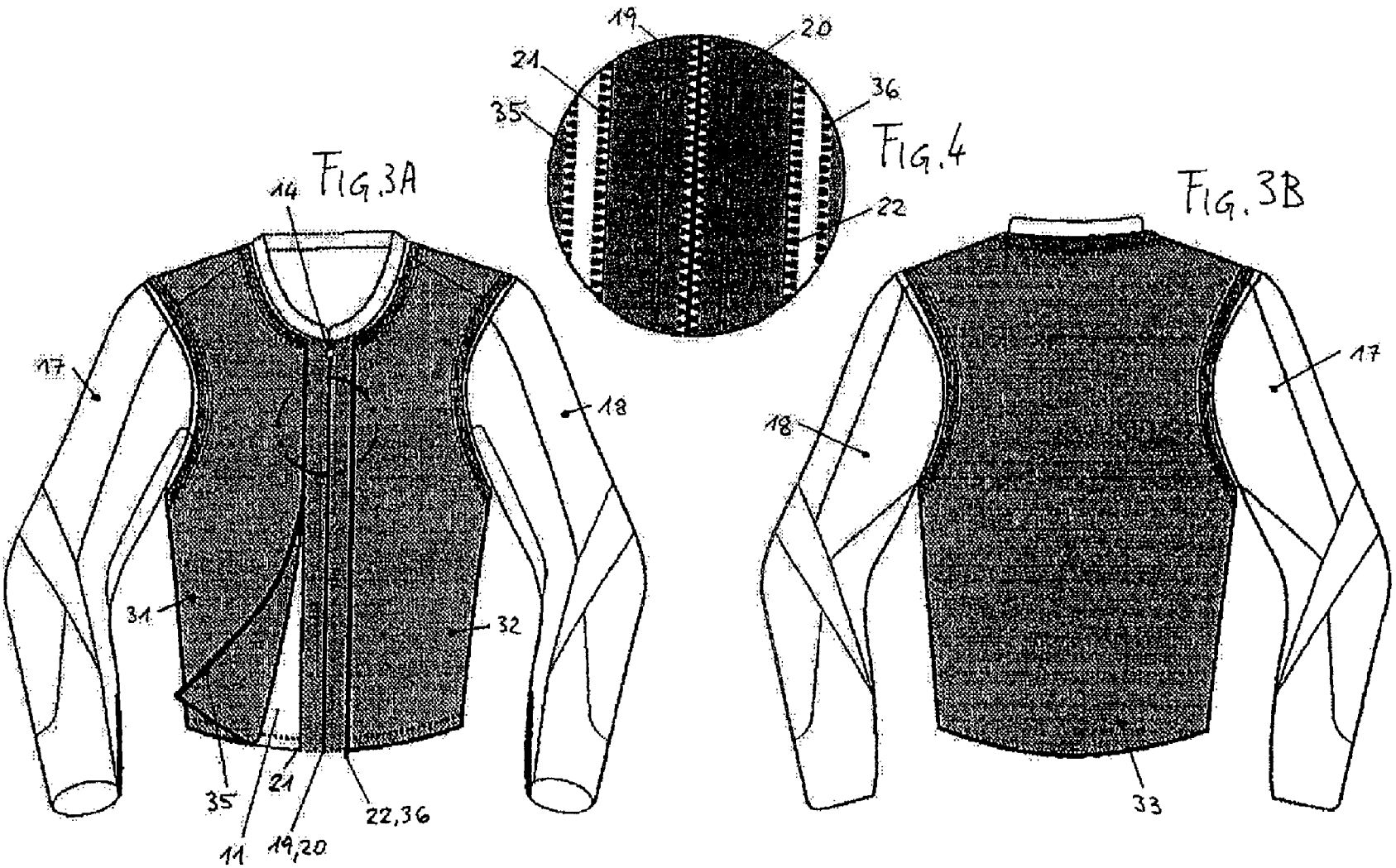
FIGS. 3A and 3B show respectively, from the front, the convertible item of clothing in the configuration where the vest shown in FIGS. 2A and 2B is worn on top of the jacket shown in FIGS. 1A and 1B.
FIG. 4 shows, on a larger scale, part of the item of clothing shown encircled by a broken line in FIG. 3A.

According to an important characteristic feature of the present invention, and for the object indicated further below, a further row of zip fastener teeth 21 and 22 is sewn onto the outer surface of each of the front portions 11 and 12 of the jacket 10, as shown in FIGS. 1A and 4. The row 21, called here fifth row of teeth, is situated at a certain distance from the first row 19, which is sewn along the free edge of the portion 11, and similarly the row 22, which is called sixth row of teeth, is situated at a certain distance from the first row 20, which is sewn along the free edge of the portion 12.

The third configuration of the present convertible item of clothing consists in the vest which is attached to the jacket 10, as shown in FIGS. 3A and 3B. For this purpose, a third fixing means is used to fix the front portion 31 of the vest 30 onto the front portion 11 of the jacket 10, and a fourth fixing means is used to fix the front portion 32 of the vest 30 onto the front portion 12 of the jacket 10.

The third fixing means consists of a zip fastener formed (in addition to another sliding engaging piece, not shown) by the third row 35 and by the fifth row 21 of teeth, while the fourth fixing means consists of a zip fastener formed (in addition to another sliding engaging piece, not shown) by the fourth row 36 and by the sixth row 21 of teeth. In other words, each of the said third and fourth fixing means consist of parts 35 and 36 of the second fixing means which, instead of co-operating to fix together the front portions 31 and 32 of the vest 30, co-operate with the further rows of teeth 21 and 22 so as to fix the said front portions 31 and 32 of the vest 30 onto the corresponding front portions 11 and 12 of the jacket 10.

As is clear, another major advantage offered by the present invention consists in the possibility of attaching and separating the vest 30 to/from the jacket 10, irrespective as to whether the jacket is open or closed. In particular, the user no longer has to remove the jacket, or at least detach the front portions of the jacket from each other, before taking off the vest attached beforehand onto the jacket (as in the case of the items of clothing according to the state of the art).

The fourth and last configuration (not shown) of the present convertible item of clothing consists of the vest 30 worn underneath the jacket 10. In this case the first fixing means is used to close the jacket and/or the second fixing means is used to the close the vest 30, while the third fixing means is not used.

In addition to that already mentioned, another advantage of the invention consists in the possibility of combining any vest, provided with a front zip fastener for fixing together the front portions thereof, with a jacket having two further rows of teeth on the outer side of the front portions, provided that the teeth are compatible. In other words, it is possible to purchase and wear the vest separately from the jacket so that the user is able to keep the jacket (which is usually less subject to wear and is made with materials generally of better quality such as leather) for a longer period of time than the vest, which instead may be replaced, even on several occasions, by a new one, for example made of other materials (for example polyester fibre), and/or by a different model (for example with or without a thermally insulating lining.

In addition to the embodiment described hereinabove, the following claims also protect other embodiments and variants of the invention, in particular an item of clothing consisting of a bodysuit (namely a top combined with a pair of trousers so as to form a single garment) instead of a jacket, and a vest; an item of clothing where the vest has sleeves usually shorter than those of the jacket or bodysuit; an item of clothing where the fixing means are at least partly different from the teeth-type sliding closures, for example VELCRO®, i.e., hook and loop fasteners, strips or automatic buttons, i.e., snap fasteners. At least one fixing means consists of buttons.

The invention claimed is:

1. A convertible item of clothing comprising:

a first part and a second part, each of the parts wearable by itself as a first and second wearable configuration, respectively, and wearable in combination with each other as a third and fourth wearable configuration, the first part comprising a first material and the second part comprising a second material, the first material being heavier and stronger than the second material, the first part being an upper torso body part of a garment;

the first part comprising a first, second, third, and fourth fixing means, the third and fourth fixing means being disposed on a front portion of the first part;

the second part comprising a vest and a fifth and a sixth fixing means, the fifth and sixth fixing means being disposed on a pair of opposed inner edges of the second part;

wherein the first and second fixing means cooperate to close the first part;

wherein the third and fifth fixing means secure a right side of the second part to the first part on the front portion of the first part, and the fourth and sixth fixing means secure a left side of the second part to the first part on the front portion of the first part; and wherein the third, fourth, fifth, and sixth fixing means comprise a component of a zip fastener, respectively.

2. The convertible item of clothing of claim 1, wherein at least one of the first and second fixing means comprising a sliding closure.

3. The convertible item of clothing of claim 1, wherein at least one of the first and second fixing means comprises a button.

4. The convertible item of clothing of claim 1, wherein at least one of the first and second fixing means comprises an automatic button.

5. The convertible item of clothing of claim 1, wherein at least one of the first and second fixing means comprises a portion of a hook and loop fastener.

6. The convertible item of clothing of claim 1, wherein the first part is a jacket.

7. The convertible item of clothing of claim 1, wherein the first part is a bodysuit.

8. The convertible item of clothing of claim 6, wherein the jacket comprises the first material.

9. The convertible item of clothing of claim 7, wherein the bodysuit comprises the first material.

10. The convertible item of clothing of claim 1, wherein the first, second, third, and fourth fixing means are disposed substantially parallel to each other.

11. The convertible item of clothing of claim 1, wherein the second part comprises a vest made by another manufacturer.

12. A convertible item of clothing comprising:

a first part and a second part, each of the parts wearable by itself as a first and second wearable configuration, respectively, and wearable in combination with each other as a third and fourth wearable configuration, the first part comprising a first material and the second part comprising a second material, the first material being heavier and stronger than the second material, the first part being an upper torso body part of a garment;

the first part comprising a first, second, third, and fourth fixing means, the first and second fixing means are disposed on opposed inner edges of the first part, the third and fourth fixing means being disposed on a front portion of the first part spaced parallel from the first and second fixing means, respectively;

the second part comprising a vest and a fifth and a sixth fixing means, the fifth and sixth fixing means being disposed on a pair of opposed inner edges of the second part;

wherein the first and second fixing means cooperate to close the first part;

wherein the third and fifth fixing means secure a right side of the second part to the first part on the front portion of the first part, and the fourth and sixth fixing means secure a left side of the second part to the first part on the front portion of the first part; and wherein the third, fourth, fifth, and sixth fixing means comprise a component of a zip fastener, respectively.

13. The convertible item of clothing of claim 12, wherein at least one of the first and second fixing means comprises a button.

14. The convertible item of clothing of claim 12, wherein at least one of the first and second fixing means comprises a portion of a hook and loop fastener.

15. The convertible item of clothing of claim 12, wherein the first part comprises a jacket.

16. The convertible item of clothing of claim 12, wherein the first part comprises a bodysuit.

17. The convertible item of clothing of claim 15, wherein the jacket comprises the first material.

18. The convertible item of clothing of claim 16, wherein the bodysuit comprises the first material.

19. A convertible item of clothing comprising:

a first part and a second part, each of the parts wearable by itself as a first and second wearable configuration, respectively, and wearable in combination with each other as a third and fourth wearable configuration, the first part comprising a first material and the second part comprising a second material, the first material being heavier and stronger than the second material, the first part being an upper torso body part of a garment;

the first part comprising a first plurality of fixing means for closing the first part and a second plurality of fixing means provided on a front portion of the first part for engaging a third plurality of fixing means provided on the second part;

wherein the second part comprises a vest;

wherein the second and third plurality of fixing means comprise a component of a zip fastener, respectively.

20. The convertible item of clothing of claim 19 wherein the first and second plurality of fixing means are substantially parallel to each other.

* * * * *